US005246640A

United States Patent [19]

Bryant

[11] Patent Number: 5,246,640

[45] Date of Patent: Sep. 21, 1993

[54] METHOD OF CONSTRUCTING A WALL FROM POURABLE CONCRETE MATERIAL

[75] Inventor: Stanley Bryant, Taree, Australia

[73] Assignee: Newtec Concrete Constructions Pty Ltd., New South Wales, Australia

[21] Appl. No.: 670,951

[22] Filed: Mar. 18, 1991

[30] Foreign Application Priority Data

Mar. 19, 1990 [AU] Australia ..... PJ9151

[51] Int. Cl.[5] ..... E04B 1/16; E04G 11/06

[52] U.S. Cl. ..... 264/35; 52/741.2; 52/743; 52/745.09; 52/745.12; 52/745.15; 249/19; 249/34; 249/35; 249/39; 264/31; 264/219; 264/334; 264/336

[58] Field of Search ..... 264/31-35, 264/219, 334, 336; 52/741, 743, 745, 807, 800, 785, 741.1-741.4, 745, 745.01-745.09, 745.1-745.19, 745.2-745.21; 249/18, 34, 39, 35, 19

[56] References Cited

U.S. PATENT DOCUMENTS

| | | | |
|---|---|---|---|
| 969,435 | 9/1910 | Adamson | 249/16 |
| 2,523,713 | 9/1950 | Mortrude, Jr. | 249/35 |
| 2,535,277 | 12/1950 | Fama | 249/34 |
| 2,610,380 | 9/1952 | Pollman | 249/34 |
| 2,661,517 | 12/1953 | Findley | 249/34 |
| 3,195,852 | 7/1965 | Lundell | 249/34 |
| 3,547,397 | 12/1970 | Brow, Jr. | 249/40 X |
| 3,954,377 | 5/1976 | Scholz et al. | 249/16 X |
| 4,052,031 | 10/1977 | Melfi | 249/19 |
| 4,138,084 | 2/1979 | Reid | 249/39 X |
| 4,159,098 | 6/1979 | Wong | 249/39 X |
| 4,426,061 | 1/1984 | Taggart | 264/35 X |
| 4,630,797 | 12/1986 | Bomford | 249/34 X |

FOREIGN PATENT DOCUMENTS

| | | |
|---|---|---|
| 0017630 | 10/1980 | European Pat. Off. . |
| 1162235 | 8/1969 | United Kingdom . |
| 1543201 | 3/1970 | United Kingdom . |

*Primary Examiner*—Karen Aftergut

*Attorney, Agent, or Firm*—Dann, Dorfman, Herrell and Skillman

[57] ABSTRACT

A method and apparatus for constructing a poured concrete wall in which the concrete is poured into forms provided between a pair of parallel-opposing panels having reinforcing therebetween. The panels are supported on frames which are adapted to be clipped together and which are adapted to be positioned on the foundation by upstanding pins set into the foundation. Window and door openings may be provided in the panels with suitable framing surrounding the same.

9 Claims, 6 Drawing Sheets

METHOD OF CONSTRUCTING A WALL FROM POURABLE CONCRETE MATERIAL

This invention relates to building structures having concrete walls and floors. In particular it relates to formwork and associated supports for the pouring of such concrete floors and walls.

There are disadvantages in the commonly accepted building practises used in Australia. Bricks are the most commonly used materials in private dwellings and small commercial buildings. However, bricks have become expensive, the labour to lay bricks is expensive and their laying requires fine weather. Window and door frames are built into the wall as the bricks are being laid. This in turn often results in damaged window/door frames and cement stained glass that is difficult to clean. It is also important to note that bricks are not suitable for areas where earth tremors are likely to occur.

The concrete tilt up system introduced over recent years leaves much to be desired. The slabs can only be handled by use of special lifting equipment, and if sealing between the joints is not carried out correctly, it allows moisture and insects to enter the building. The finishing designs and styling are limited in the tilt up system.

The existing construction methods of concrete walls poured in-situ are cumbersome. The formwork has to be erected by tradesmen and a large percentage of materials are not reuseable after the concrete is poured. Furthermore the formwork on both sides of any wall is tied together using bolts passing through the wall cavity. Not only does this result in a wall having many holes passing through it which require filling, but the bolts are both expensive and require much labour to insert and remove. Other methods using preformed steel are specially constructed for specific jobs such as grain storage or lift wells. However, these systems are not suitable use in the general and domestic building industry.

The invention has been devised to improve the standard of buildings both in construction and design and at the same time:

a) Reduce costs,
b) Reduce building time,
c) Provide a means that will economically allow the concrete walls to be dowelled to the concrete foundations,
d) Introduce a standard method of building with reuseable equipment and materials that are lightweight and can be manually assembled and disassembled by semi-skilled tradesmen,
e) Enable the adoption and use of a variety of mass produced external and internal fittings.
f) Provide precast door and window openings, enabling doors and windows to be fitted in the final stages of the building program after painting.

In one broad form the invention provides a method of constructing a poured concrete wall comprising the steps of:

a) providing a foundation extending transversely on both sides of the wall;
b) providing at least one pair of parallel opposing panels for defining the vertical surfaces of the wall along the wall line;
c) securing the top edges of the at least one pair of panels a preset distance apart with spacing means;

d) securing the bottom edges of the at least one pair of panels to the foundation or holding brackets at said preset distance apart;
e) securing horizontal reinforcing means to the outer surfaces of the at least one pair of panels;
f) securing vertical reinforcing means to the panels to sandwich the horizontal reinforcing means against the panels;
g) pouring concrete into the wall cavity to form said wall.

In another broad form the invention provides a reusable formwork for the pouring of walls, comprising:

at least one pair of first frames including wall defining surfaces;
first means for locating top edges of the wall defining surfaces of said at least one pair a set distance apart in substantially parallel opposing relationship;
second means for locating bottom edges of the wall defining surfaces said set distance apart;
horizontal beams attached to the outer surfaces of the at least one pair of first frames for providing horizontal reinforcement thereto;
at least one pair of support frames adapted to hang from said first pair of frames and including vertical reinforcing means, for vertical reinforcement of said wall defining surfaces; and,
third means adjacent said bottom edges for urging the support frames tightly against the horizontal beams.

BRIEF DESCRIPTION OF THE DRAWINGS

FIG. 7*a* shows a top view of a clamp used to clamp the frames together while

DETAILED DESCRIPTION OF PREFERRED EMBODIMENTS OF THE INVENTION

The construction of concrete slab floors upon which walls are built is a standard technique and hence it is assumed the reader is well aware of such techniques. However in applying the invention some minor modifications are required or preferable.

Firstly, as already mentioned, conventional concrete wall formwork is internally braced, while this invention provides formwork which is externally braced only. It is thus to provide means secured in the floor to take some of the loads generated by the concrete in the wall prior to setting. In one embodiment it is necessary that the "floor" extend beyond the wall line so that the external formwork can be anchored securely. The "floor" may extend to form a path around the building, which is frequently provided separately anyway.

Securing of the formwork in the preferred embodiments utilises pins anchored in the floor and path. The pins holes may be cast when the floor and path are poured or alternatively once the floor and path have hardened, holes may be drilled for the pins.

Figure 9:
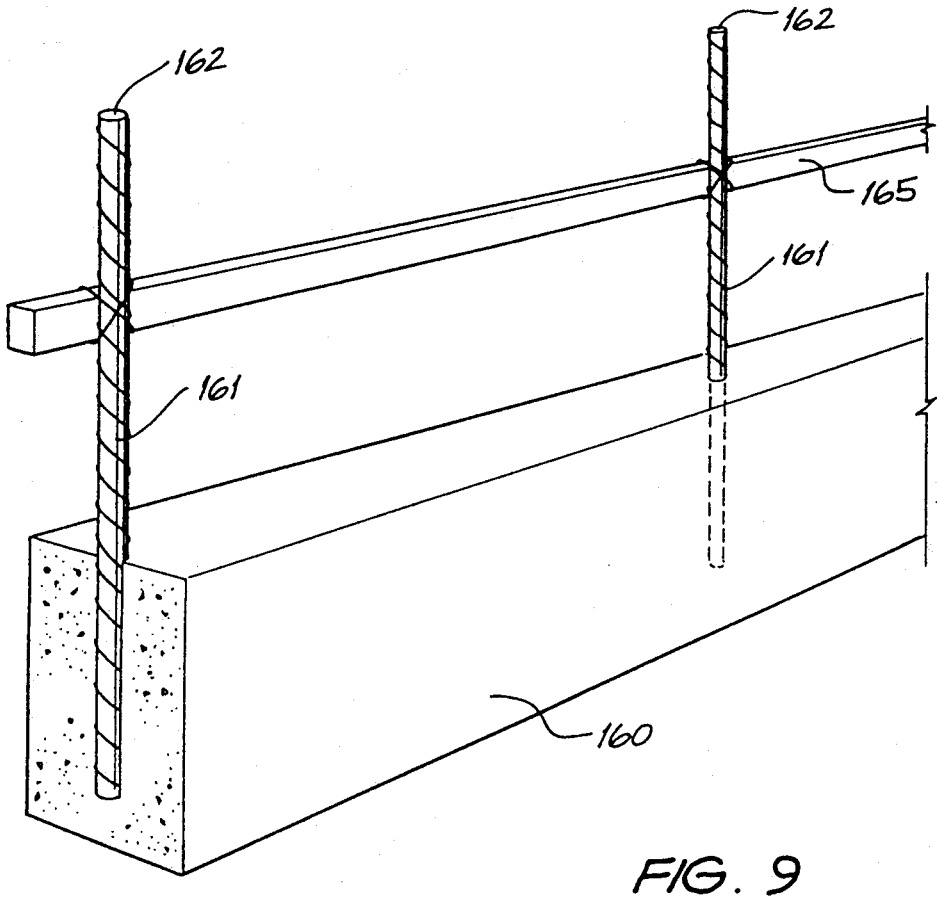
FIG. 9 shows a foundation prior to pouring of the floor.
Figure 10:
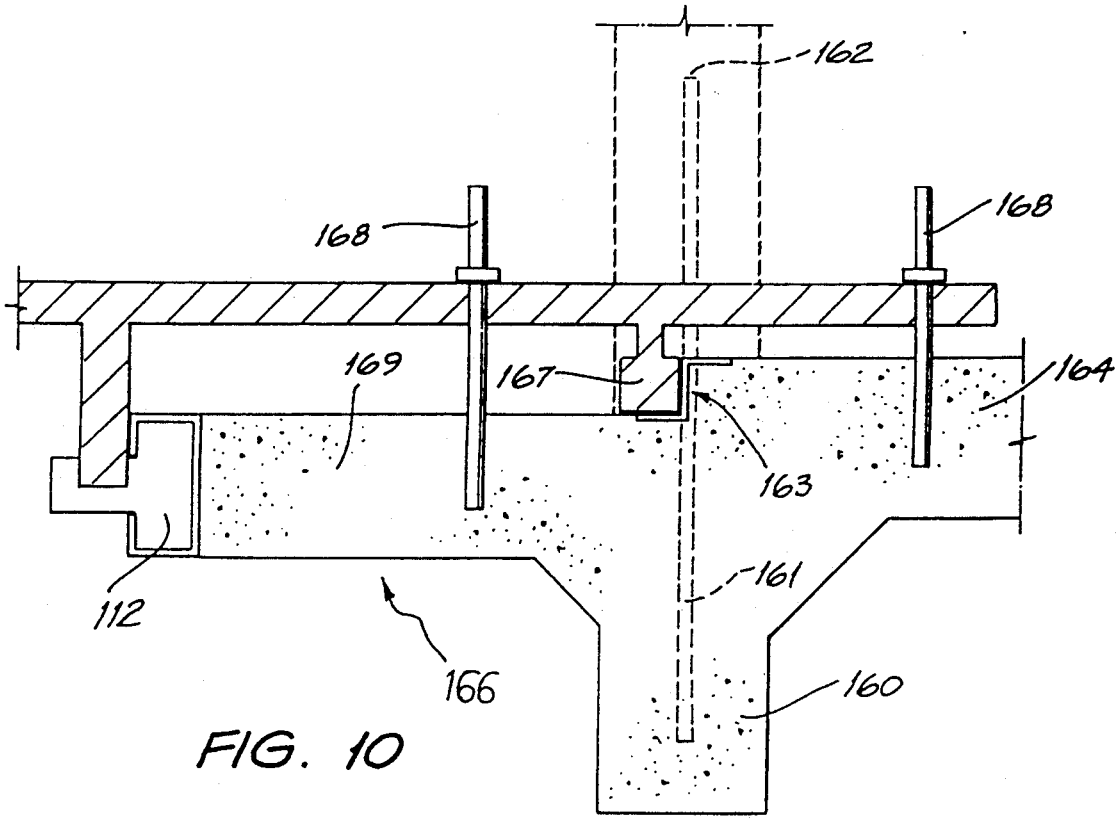
FIG. 10 shows a cross-section of the floor and paths poured with formwork in position.

Referring to FIGS. 9 and 10 preferably the floor foundations 160 are laid with a series of vertical spaced steel bars 161 protruding upwards along the centre line of the prospective wall. The bars 161 extend so that their upper ends 162 will protrude above the upper surface of the floor 164 once laid. These bars 161 will tie the wall to the floor and foundations thereby providing a sound structure.

It is preferable that a "water stop" step 163 be formed at the periphery of the floor 164 so that water will be less liable to seep onto the floor 164. This may be achieved by using a simple bar 165 attached to the bars 161 such that it forms an edge for the floor 164.

Alternatively, referring to FIG. 10 a more complicated form, indicated generally by 166 may be used. This form 166 includes the side rail 112 for defining the edge of any paths 169 around the building. The form 166 also includes a ridge former 167 and two pin hole rods 168. The form 166 is anchored in the ground (not shown) to resist forces generated during pouring of the floor 164 and path 169 and preferably is anchored to the bars 161 such that the step 163 is positioned accurately relative to the bars 161. Once the floor 164 and path 169 have set the form 166 is removed and pins may be inserted into pin holes formed by rods 168. Alternatively the rods 168 may be left anchored in the concrete and act as the pins.

Figure 1:
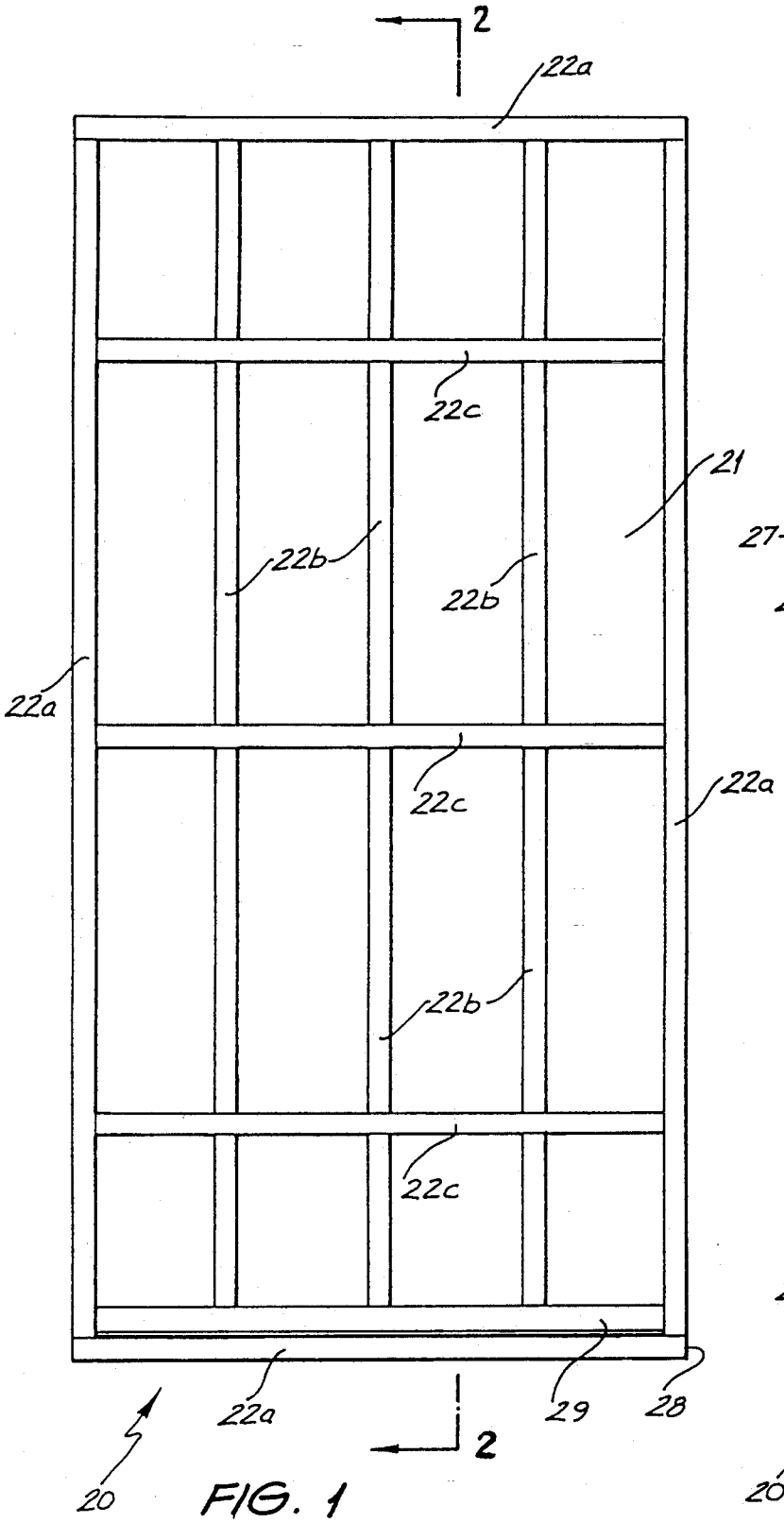
FIG. 1 shows a side view of a panel used in the invention.
Figure 2:
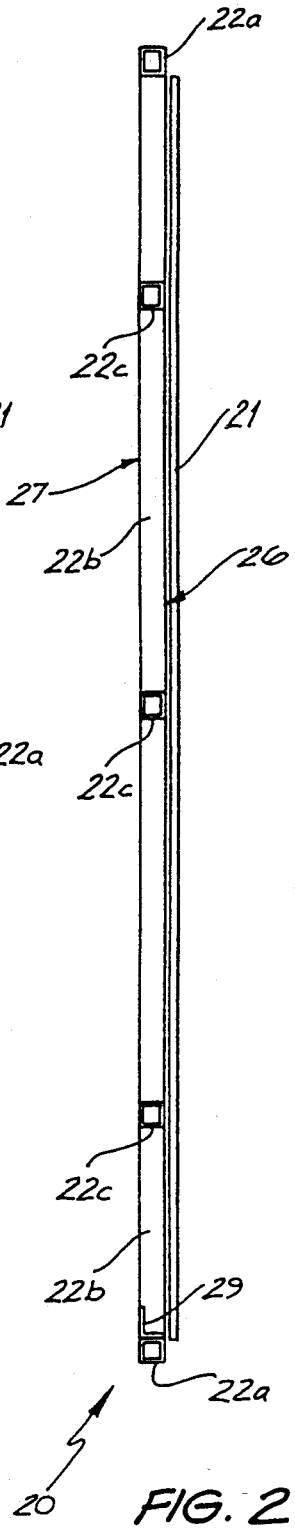
FIG. 2 shows a cross-section of the panel of FIG. 1 taken along line 2—2.

Referring to FIGS. 1 and 2, there is shown the lightweight inner frame 20 upon which plywood sheets 21 are attached. The frame 20 is 1.2 m high (this being a standard floor to floor height) and 1.2 m wide. Obviously for different floor to floor heights the size of the frame 20 will vary appropriately. The frame 20 is constructed of 50 mm × 50 mm (rectangular hollow section) bars 22*a*, 22*b* and 22*c*. In addition to having perimeter bars 22*a* there are three vertical bars 22*b* and three horizontal bars 22*c* within the perimeter bars 22*a*. All the bars 22 are butt jointed such that the inner and outer sides 26 and 27 respectively are flush. The plywood sheets 21 are attached to the inner face 26 of frame 20 by suitable means, such as self-tapping screws. At the lower edge 28 of the frame 20 there is provided a vertical plate 29, preferably by using a piece of angle iron. If a step has been provided between floor and path the external panels are slightly taller to compensate for the step, such that the upper edges of the internal and external panels are at the same height.

Figure 3:
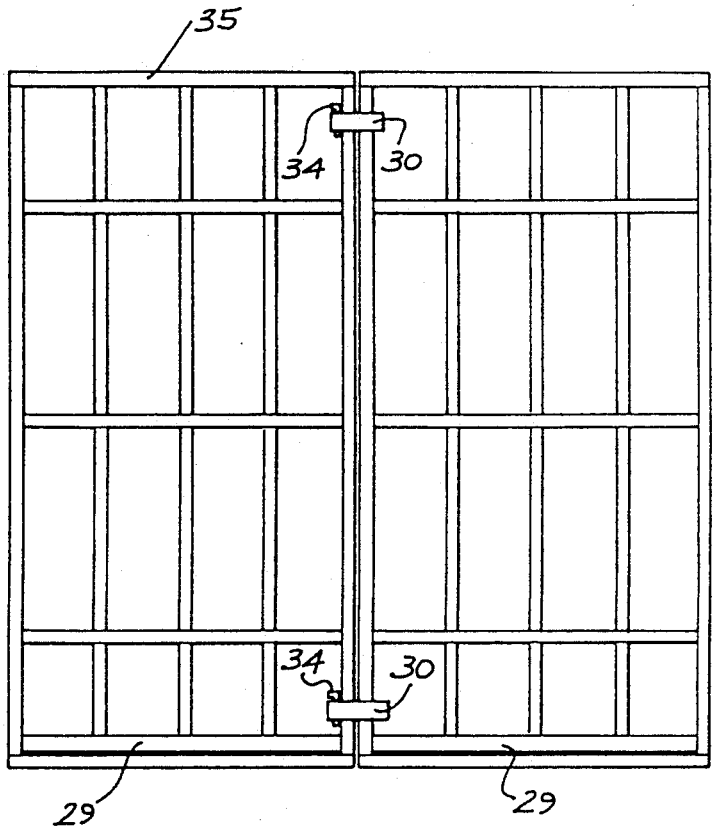
FIG. 3 shows two panels of FIG. 1 joined together.
Figure 4:
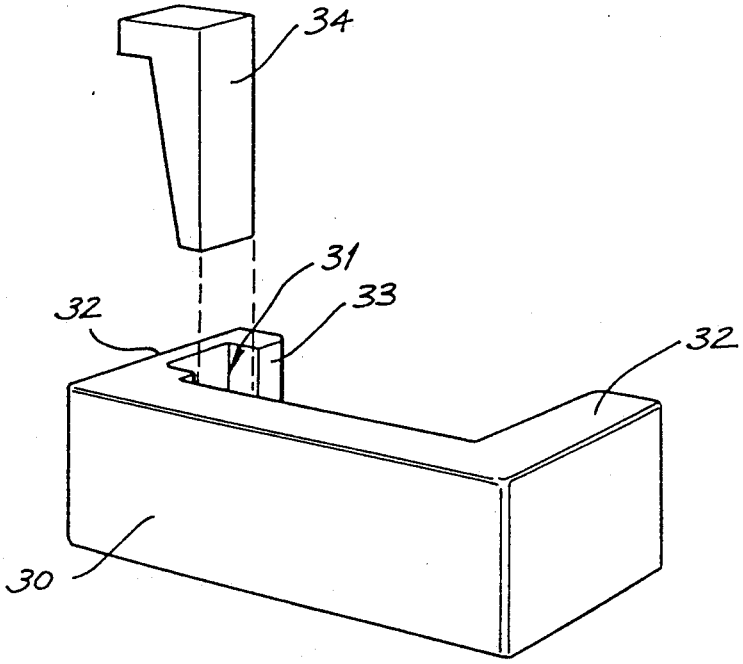
FIG. 4 shows a clamp used for joining the panels together.
Figure 6:
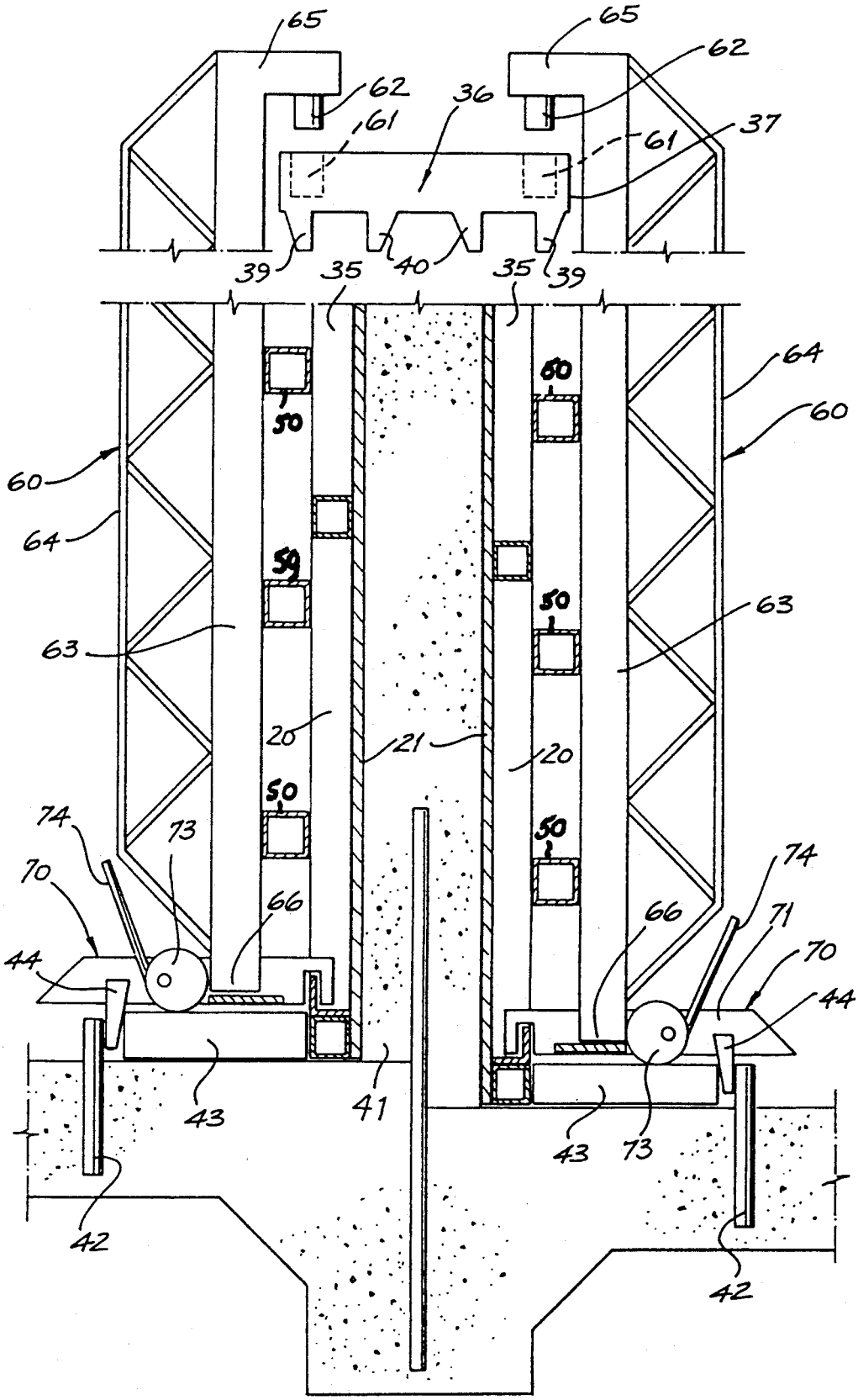
FIG. 6 shows a cross-section of the fully errected formwork including external reinforcing frames.

In use, the frames 20 are aligned edge to edge in two opposing rows on either side of the wall centre line, as shown in FIGS. 3 and 6. Adjacent frames 20 are joined together by means of clips 30. These clips 30 are U-shaped having a groove 31 in the inner face 33 of one of the legs 32, as shown in FIG. 4. The spacing of the legs 32 is sufficient for them to slide onto adjacent bars 22*a* of adjacent frames 20. A wedge 34 is driven into the groove 31 to firmly clamp the two frames, and hence plywood sheets 21, together.

Clips 36 (shown in FIG. 6) are provided to clip opposing frames 20 together at their upper edges 35 at the required separation. These clips 36 have a horizontal rail 37 from which depend four legs 39, 40. The legs can simply be plate reinforced with a fillet to prevent distortion. The legs comprise outer legs 39 and inner legs 40. The spacing of an adjacent inner and outer legs 39, 40 is such that the upper edge 35 of the respective frame will snugly slide into the gap therebetween. The gap between the inner legs 40 determines the spacing of opposing frames 20 and hence the thickness of the wall. The clips 36 are preferably spaced at 900 mm centres along the wall. Closer spacing is unnecessary while larger spacing greater than 1.2 m allows bulging of the panels when the concrete is poured, resulting in an unacceptable product.

The lower edges 41 of the frame 20 are located correctly utilising pins 42 secured in the floor and path. Preferably the pins are spaced on 800 mm centres. Up to 1200 mm spacing is possible but beyond this the panels bulge. Blocks 43 are placed between the pins 42 and edges 41 and wedges 44 driven between pins 42 and blocks 43 to correctly position edges 41. The wedges 44 provide a means to release the pressure when dismantling the formwork.

Figure 5:
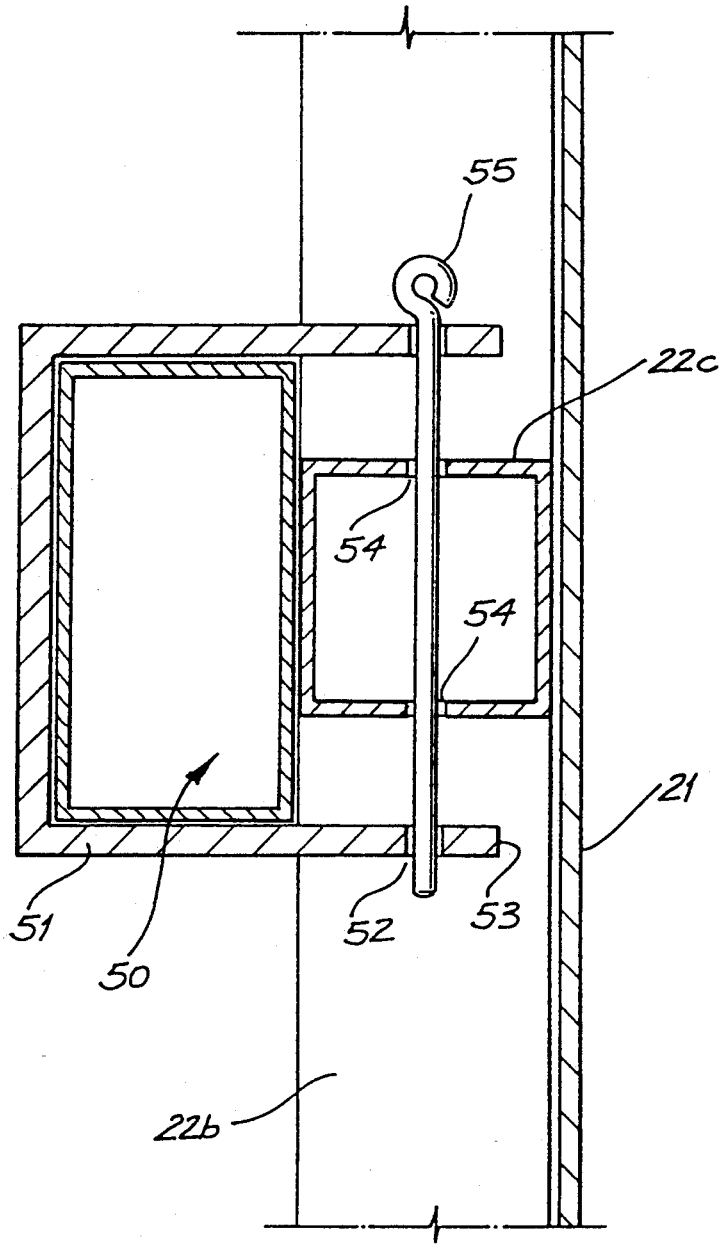
FIG. 5 shows an enlarged cross-section of one of the panels of FIG. 1 with a horizontal bar attached.

While the frames 20 are lightweight to be positioned by two workmen, they have insufficient strength to maintain their shape during pouring and setting of the concrete walls. In particular the step of vibrating the concrete to release trapped air bubbles generates high loads which distort the frames unless otherwise reinforced. Horizontal reinforcing is provided by horizontal bars 50 (see FIG. 5). These bars are, preferably, R.H.S. and are attached to the frames 20 over the horizontal bars 22*c* and using U-clamps 51. The U-clamps 51 have eyes 52 at their free ends 53 while the horizontal bars 22*c* have vertical holes 54 passing therethrough. Pins 55 are passed through eyes 52 and holes 54 to hold the bars 50 to the frames 20. To ensure that bars 50 are tight against frames 20 wedges, not shown, may be driven between the bars 50 and U-clamps 51. Three bars 50 are used for each frame 20, overlapping all three bars 22*c*. To ensure that the frames 20 are aligned correctly along the length of the wall the-bars 50 should be as long as possible to interlink as many frames 20 as possible along a straight line. In practice, bars 50 of about 6 m length are preferable, since these are easily manhandled—any longer they become too unweildly while any shorter, the wall may have too many kinks in its alignment. Thus four complete frames 20 may be linked together as one unit with the bars 50 extending on either side to overlap halfway on the next frame 20.

Vertical reinforcement is provided by external support frames 60 which hang from clips 36 as shown in FIG. 6. Clips 36 have vertical bores, or holes, 61 into which legs 62 of frames 60 are engaged. The support frames 60 comprises vertical bar 63 strengthened by a truss 64. At the upper ends of the bars 63 are inwardly extending legs 65 from which legs 62 depend.

Figure 8:
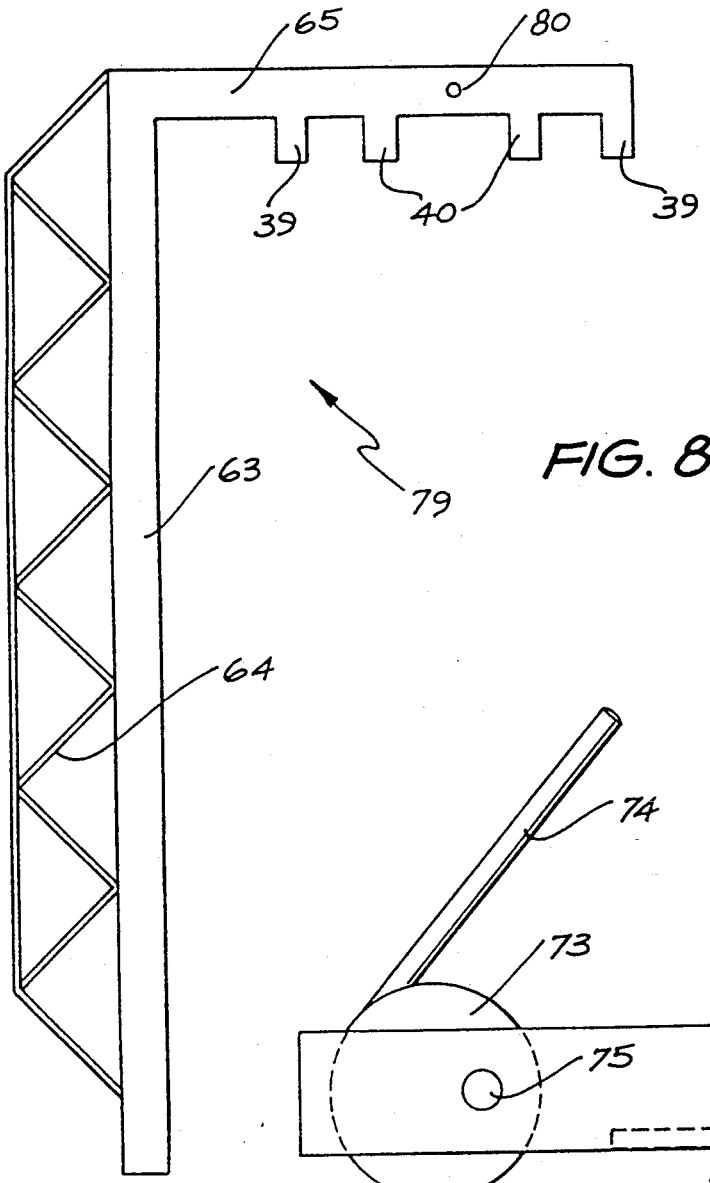
FIG. 8 shows an alternate form of the external vertical reinforcing frames.

Alternative external frames 79 are shown in FIG. 8. These frames combine the clips 36 with the legs 65 to form a single unit. The legs 39, 40 are placed over the frames 20 as previously described and a pin is passed through hole 80 to secure two frames, one on each side of the wall together.

Figure 7B:
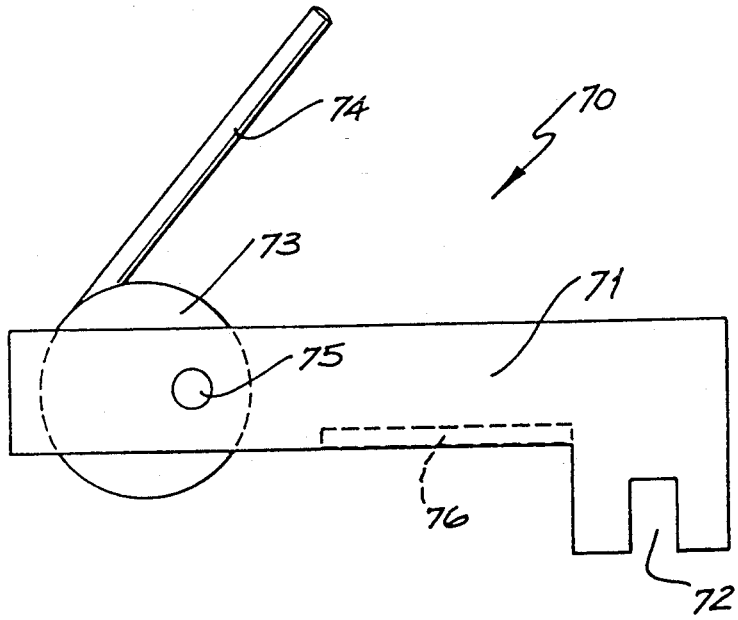
FIG. 7*b* shows a side view of the clamp.
Figure 7A:
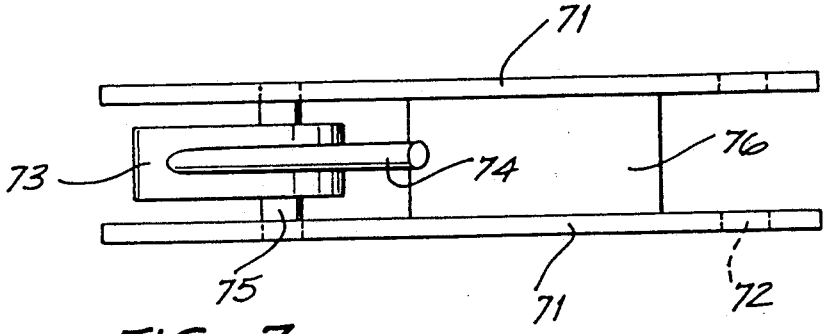

Clamps 70 (see FIGS. 7*a* and 7*b*) are provided to clamp the lower ends 66 of bars 63 firmly against the horizontal bars 50. The clamps 70 comprises two spaced apart bars or legs 71 having a vertical slot 72 at one end sized so as to receive vertical plate 29 of frame 20. At the other end, the legs 71 are jointed by flat plate 76. A disc 73 is mounted eccentrically on a horizontal axis 75.

Disc 73 is rotatable by arm 74 and, by suitable rotation, pushes the vertical bars 63 firmly against horizontal bars 50, thereby providing both vertical and horizontal reinforcement of the frames 20.

During erection of the formwork the inner frames 20 are erected with any door and window opening formwork attached to the inner frames 20. These opening formworks are of a standard size. The wall reinforcement is placed in position in the prospective wall cavity and then the outer frames are erected and clamped in position.

Once all the frames are in position, the concrete may be poured/pumped into the cavity between opposing frames 20 and the walls of the building so formed.

When the concrete has set sufficiently to be self supporting, one merely loosens clamps 70 and lifts frames 60 upward to disengage legs from bores in clips 36. The clips 36 and wedges 44 can then be removed to give access to frames 20 which are dismantled in the reverse operation to that described.

It is desirable to fit the roof to the building, paint the walls and then fit any windows or doors in position. This enables the walls to be spray painted without the need to mask doors and windows from paint over spray.

Although the invention has been described with reference to building ground floor walls, it is possible to use the invention to build higher level floors. It is obvious that a suitable foundation must be provided for the formwork, and this can be provided by clips or brackets attached along the upper edges of the wall already cast.

It will be obvious to one skilled in the art that many modifications and variations may be made to the invention described without departing from the spirit or scope thereof.

I claim:

1. A method of constructing a wall from pourable concrete material with reusable formwork comprising the steps of:

a) providing a foundation extending transversely on both sides of the wall to be formed;

b) positioning locating pins in the foundation on both sides of the wall to be formed;

c) provding and erecting at least one pair of parallel opposing panels for defining vertical surfaces of the wall to be formed along a wall line and for defining a wall cavity therebetween for receiving the pourable material;

d) spacing bottom edges of the erected panels a preset distance apart and abutting the bottom edges directly or indirectly against the locating pins;

e) clipping top edges of the erected panels a preset distance apart with spacing means positioned outside of the wall cavity;

f) positioning horizontally extending reinforcing means outside of the wall cavity and releasably securing the horizontally extending reinforcing means to outer surfaces of the erected panels;

g) positioning vertically extending reinforcing means outside of the wall cavity and hanging top portions of the vertically extending reinforcing means from the spacing means;

h) releasably securing bottom portions of the vertically extending reinforcing means to the bottom edges of the erected panels; and, i) pouring pourable material into the wall cavity to form the wall, whereby the wall so formed is free from passageways and cavities generated by clips or other support structure reinforcing the erected panels.

2. The method of claim 1 wherein the foundation comprises a floor on a first side of the wall and a path on a second side.

3. The method of claim 2 wherein step a) includes providing a step in the foundation beneath the wall cavity.

4. The method of claim 1 wherein the clipping step comprises providing spacing means spaced from one another on about 900 mm centres.

5. The method of claim 1 wherein the pins are spaced at about 800 mm centres.

6. The method of claim 1 further including the step of placing formwork in the wall cavity for forming door or window openings in the wall being formed.

7. A method according to claim 1 wherein the vertically extending reinforcing means sandwiches the horizontally extending reinforcing means between the erected panels and the vertically extending reinforcing means.

8. A method of claim 1 wherein the hanging step comprises placing an inwardly-projecting portion of the vertically extending reinforcing means upon an upper horizontal surface of the spacing means and engaging a downwardly-extending securing pin on the inwardly-projecting portion into a complementary bore in the upper horizontal surface of the spacing means.

9. The method of claim 1 further including the steps of j) allowing the pourable material in the wall cavity to set sufficiently to form a self-sustaining wall and k) dismantling the reusable formwork by lifting and disengaging the vertically extending reinforcing means from the spacing means, then removing the horizontally extending reinforcing means from the outer surfaces of the erected panels, and then displacing the panels from the self-sustaining wall formed in the wall cavity.

* * * * *

UNITED STATES PATENT AND TRADEMARK OFFICE

CERTIFICATE OF CORRECTION

PATENT NO. : 5,246,640

DATED : September 21, 1993

INVENTOR(S) : Stanley Bryant

It is certified that error appears in the above-identified patent and that said Letters Patent is hereby corrected as shown below:

Col. 3, line 37, "1.2 m high" should read --2.4 m high--

Column 3, line 41, after "50 mm x 50 mm" insert --R.H.S.--.

Signed and Sealed this

Third Day of May, 1994

Bruce Lehman

*Attest:*

BRUCE LEHMAN

*Attesting Officer*

*Commissioner of Patents and Trademarks*